United States Patent [19]

Brenner

[11] Patent Number: 4,520,638

[45] Date of Patent: Jun. 4, 1985

[54] TRIPLE ACTION AGITATOR FOR AUTOMATIC WASHERS

[75] Inventor: Robert A. Brenner, St. Joseph Township, Berrien County, Mich.

[73] Assignee: Whirlpool Corporation, Benton Harbor, Mich.

[21] Appl. No.: 558,874

[22] Filed: Dec. 7, 1983

[51] Int. Cl.[3] ..... D06F 17/08

[52] U.S. Cl. ..... 68/133; 74/126

[58] Field of Search ..... 68/131, 133, 134; 74/126, 21, 99 R, 99 A

[56] References Cited

U.S. PATENT DOCUMENTS

| | | | |
|---|---|---|---|
| 2,226,137 | 12/1940 | Pool . | |
| 2,371,498 | 3/1945 | Boynton | 74/21 X |
| 2,430,211 | 11/1947 | Cheney | 68/131 |
| 2,910,876 | 11/1959 | Jackson | 74/126 X |
| 3,503,086 | 3/1970 | Mason et al. | 68/133 X |
| 3,678,714 | 7/1972 | Krolzick | 68/131 |
| 4,193,275 | 3/1980 | Bochan | 68/134 |
| 4,452,054 | 6/1984 | Hafstrom | 68/133 |

FOREIGN PATENT DOCUMENTS

| | | | |
|---|---|---|---|
| 724879 | 1/1966 | Canada | 68/131 |

*Primary Examiner*—Philip R. Coe

*Attorney, Agent, or Firm*—Hill, Van Santen, Steadman & Simpson

[57] ABSTRACT

An agitator thruster is provided for an automatic washer for increasing the rollover of clothes during the agitation portion of a washing cycle wherein the thruster moves in a vertical reciprocating motion by action of a pin carried by the thruster engaging angled side walls of a channel in the agitator barrel and being caused to move in one direction around the channel circuit, up along one angled channel wall and down along another.

15 Claims, 12 Drawing Figures

FIG. 7
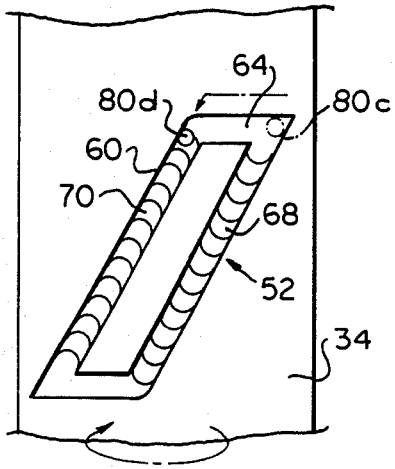
FIG. 8
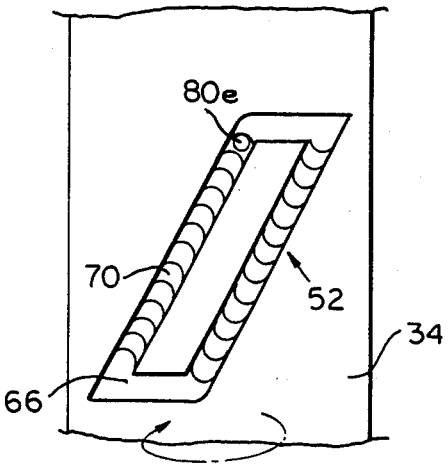
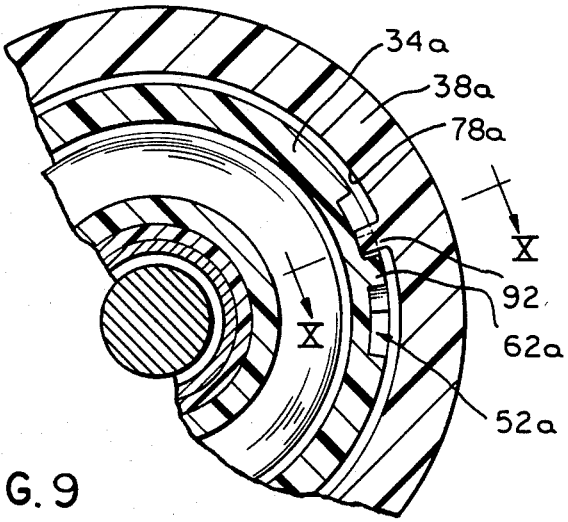
FIG. 9
FIG. 10
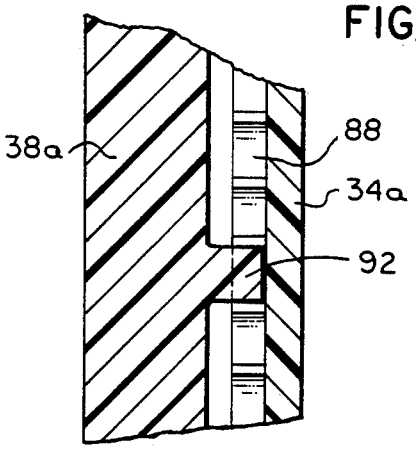
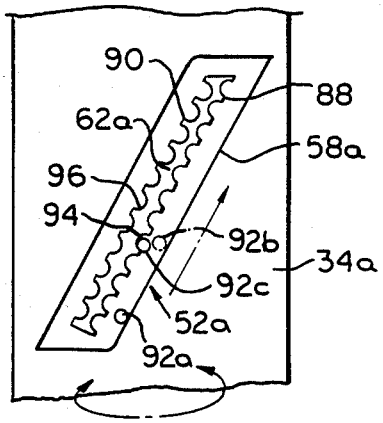
FIG. 11
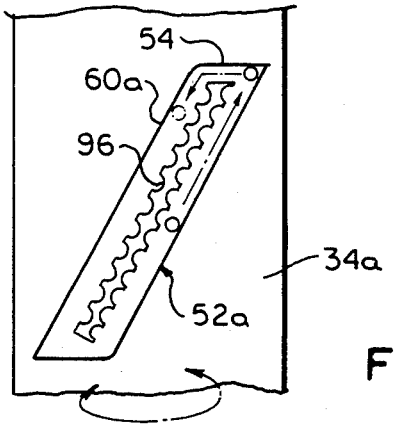
FIG. 12

TRIPLE ACTION AGITATOR FOR AUTOMATIC WASHERS

BACKGROUND OF THE INVENTION

1. Field of the Invention

This invention relates to an automatic washing machine agitator construction and more specifically to an agitator construction wherein the agitator is comprised of an oscillatory rotating portion and a vertically reciprocating portion.

2. Description of the Prior Art

A number of different types of agitating structures are disclosed in the prior art for automatic washing machines which provide both reciprocatory and rotary movement of an agitator. For example, U.S. Pat. Nos. 3,678,714 and 4,193,275 both disclose thrusters which are driven in reciprocating motion by the oscillatory motion of the agitator shaft. In the '714 patent, the thruster is driven by driving legs riding on a cam member. In the '275 patent, the thruster is driven by a screw thread on the agitator shaft when the force of the clothes in the basket prevent rotational movement of the thruster. Both thrusters disclosed have a reciprocation period equal to or greater than the oscillation period of the agitator.

SUMMARY OF THE INVENTION

The purpose of the present invention is to provide an improved washing action by increasing the rollover of the articles to be washed. This improved washing action is accomplished by means for securing both oscillation and vertical reciprocation in an agitator element. The agitator is particularly designed for those types of washing machines which include a perforate basket assembly connected to a vertically disposed shaft, with an oscillating agitator being disposed in the perforate basket and having a shaft which is concentric with the shaft which rotates with the perforate basket. Drive means are provided to selectively drive the perforate basket continuously in a wash liquid extraction stage, and to oscillate the agitator vanes during the washing cycle.

In accordance with the present invention, a secondary agitator provides vertical movement in the wash liquid during agitation. The preferred form of the invention involves the use of a recessed parallelogram shaped area with horizontal top and bottom edges and inclined sides which is formed on an outer surface of the inner agitator barrel. On an interior surface of the thruster barrel is a pin that moves within the parallelogram area. Means are provided within the parallelogram to ensure that the pin moves along the perimeter of the parallelogram in one direction of movement which results in an intermittent vertical reciprocation of the thruster barrel and limited rotational movement. The outside surface of the thruster barrel carries means for imparting motion to the clothes and water within the tub such as vanes, either vertical or angled, or various types of cones.

Through the use of the combined reciprocation and oscillation, an improved washing action is obtained through the increased rollover of the articles being washed. Because of this improved washing action, a larger capacity load can be washed than would be possible with a conventional agitator which provides only rotary oscillation. The present invention produces the required rollover of a heavy clothes load within acceptable power usage requirements.

The configuration of the recessed areas in the agitator can be varied to provide a wide range in the period of reciprocation of the thruster barrel and to allow the principles of the present invention to be adapted to any possible washer configuration and requirement.

BRIEF DESCRIPTION OF THE DRAWINGS

FIG. 7 is a schematic view of the pin moving in a horizontal section of the parallelogram in the counter clockwise direction of rotation of the agitator barrel.

FIG. 8 is a schematic view of the pin being captured in the counter clockwise direction of rotation of the agitator barrel.

FIG. 9 is a partial top sectional view through the agitator showing a second embodiment of the present invention.

FIG. 10 is a partial side sectional view through the agitator taken generally along the lines X—X of FIG. 9.

FIG. 11 is a schematic view of the pin moving in the parallelogram of the second embodiment in both directions of rotation of the agitator barrel.

FIG. 12 is a schematic view of the movement of the pin in the parallelogram in both directions of rotation of the agitator barrel.

DESCRIPTION OF THE PREFERRED EMBODIMENT

Figure 1:
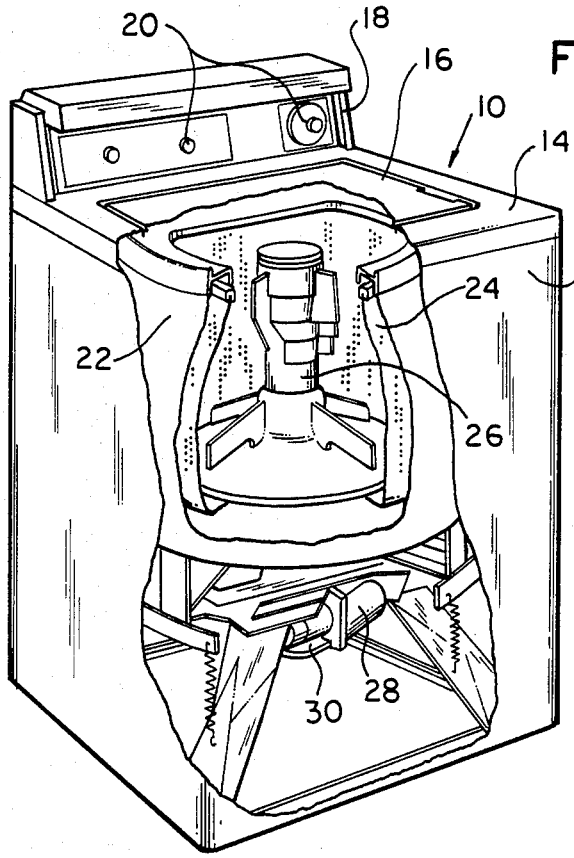
FIG. 1 is a perspective view of a washing machine embodying the present invention, partially cut away to show the interior mechanism thereof.
Figure 3:
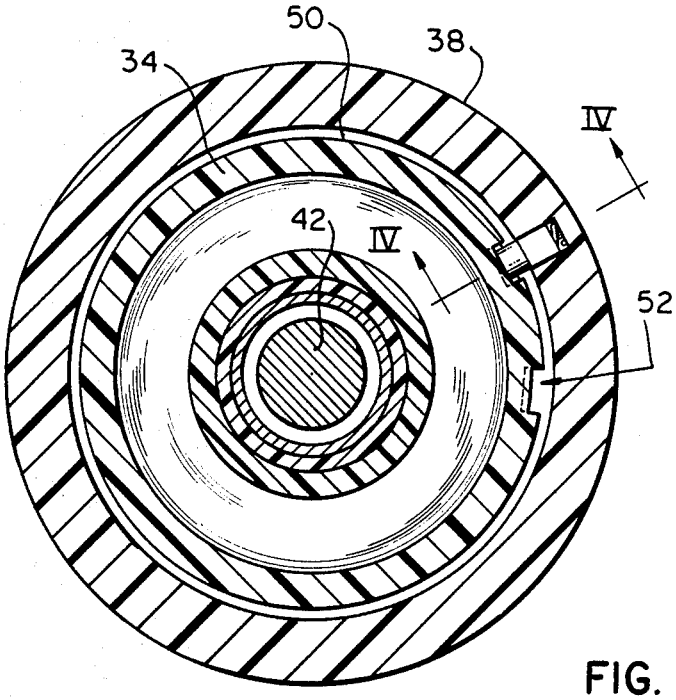
FIG. 3 is a top sectional view through the agitator taken generally along the lines III—III of FIG. 2.

A laundry appliance 10 comprising an automatic clothes washer embodying the principles of the present invention is depicted in FIG. 1. The washer is comprised of a cabinet 12 having a top 14 with a lid 16 and a console 18 having presettable controls 20 thereon of the type wherein an operator may preselect a program of automatic washing, rinsing, and drying steps in a laundering process. The lid 16 in the top 14 of the cabinet 12 permits access into the top of a tub 22 housed within the cabinet 12. Enclosed and supported within the tub 22 is a clothes container or spin basket 24 within which is oscillatably mounted an agitator 26.

Figure 2:
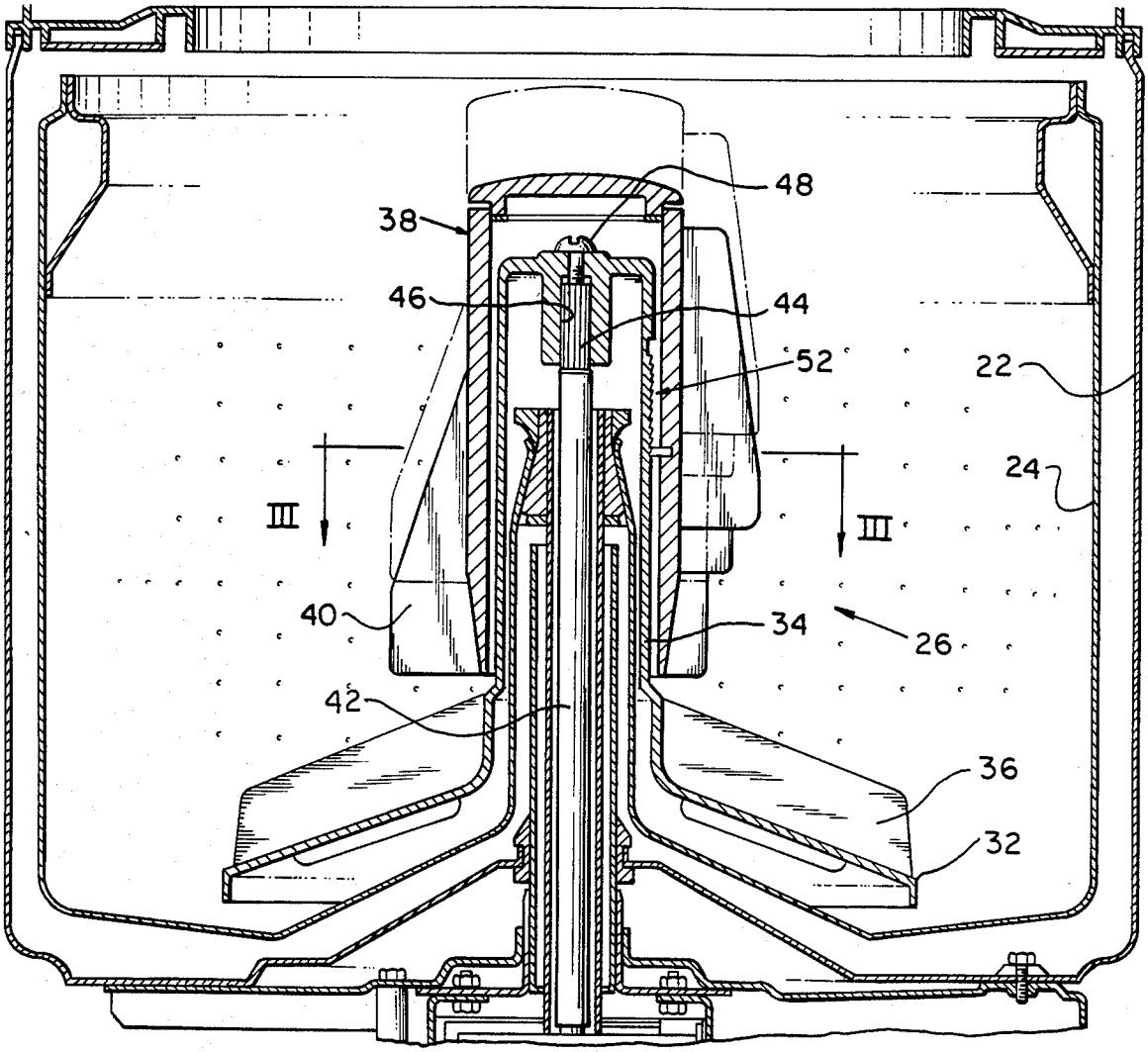
FIG. 2 is a side sectional view of the agitator assembly within the tub and basket of the washing machine.

Below the tub 22 but within the cabinet 12 there is provided an electric motor 28 which oscillatably drives the agitator 26 through a transmission 30. The agitator 26 is shown in greater detail in FIG. 2 where it is seen that the agitator 26 is comprised of a skirt portion 32 near the bottom of the agitator and a substantially vertical barrel portion 34 integrally connected with the skirt and projecting upwardly therefrom. A plurality of pumping vanes 36 are provided around the periphery of the barrel 34 and extend downwardly and outwardly along the skirt portion 32 of the agitator 36.

A thruster portion 38 of the agitator is mounted concentrically about the barrel portion 38 and above the pumping vanes 36. The thruster portion 38 has a plurality of thrusting vanes 40 provided around the periphery of the thruster 38 which extend downwardly and outwardly along the entire length of the thruster portion 38.

A drive shaft 42 for the agitator extends upwardly through the barrel portion 34 of the agitator and is drivingly connected to the barrel portion by means of a splined end 44 matingly engaging a conversely shaped opening 46 in the barrel 34. Fastening means 48 such as a screw retains the splined connecting portions in a fixed axial relationship. Thus, oscillation of the drive shaft 42 oscillates the barrel 34 via the splined connections 44, 46 on the barrel drive shaft 42 and the barrel 34.

On an outer surface 50 of the barrel 34 is provided a recessed area 52 which is shown schematically in FIGS. 5 through 8 as having the shape of a parallelogram. The parallelogram 52 has a horizontal top edge 54, a horizontal bottom edge 56 and inclined side edges 58, 60. Within the recessed area 52, parallel and spaced from the inclined surfaces is a raised land area 62 which forms four connected channel legs along the sides of the recessed area 52. Channel leg 64 is adjacent and parallel to side 54, channel leg 66 is adjacent and parallel to side 56, channel leg 68 is adjacent and parallel to side 58 and channel leg 70 is adjacent and parallel to side 60. The angled channels 68, 70 both have fish scale type bottom wall surfaces 72, 74 with a profile best seen in FIG. 4 comprising a plurality of curved ratchet teeth 76 having face surfaces 77. The direction of the ratchet teeth are opposite in the two channels 68, 70.

Projecting from an inner surface 78 of the thruster 38 is a cylindrical pin 80 carried in a complementarily shaped cavity 82. A spring member 84 is used to bias the pin 80 in an outward direction. A front flat face 86 of the pin 80 is positioned at an angle so that it is complementary to face 77 of the ratchet teeth 76.

Figure 5:
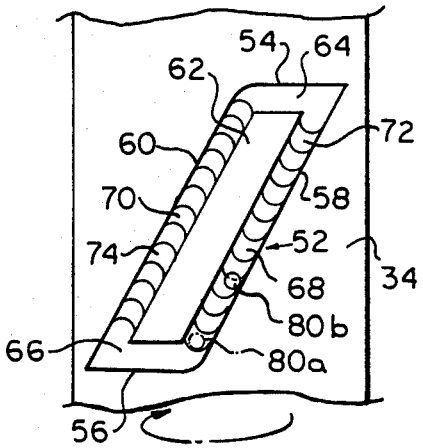
FIG. 5 is a schematic view of the movement of the pin within the parallelogram recess in a clockwise direction of rotation of the agitator barrel.

FIG. 5 schematically shows the movement of the pin 80 relative to the channels during rotation of the agitator barrel 34. During a washing cycle, the clothes in the washer tend to resist rotational movement and thus the thruster 38 is restrained against rotational movement. As the barrel 34 moves in a clockwise direction as viewed from above the agitator, the pin 80, which starts out as illustrated in position **80*a* near the bottom of the channel 68, is caused to ride against side 58 and is cammed upwardly, for instance to the position shown in full lines at 80*b***.

Figure 4:
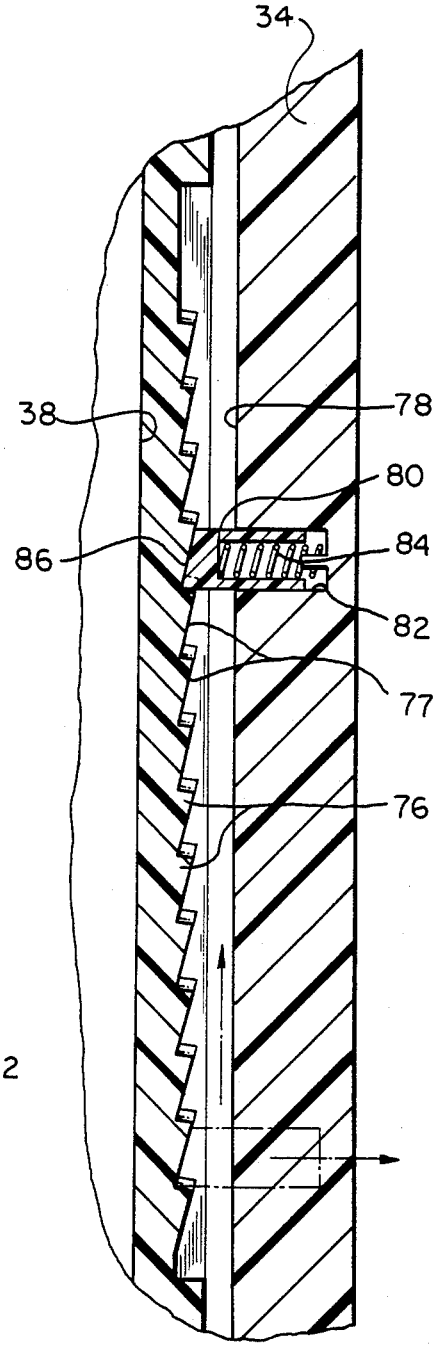
FIG. 4 is a partial side sectional view through the agitator taken generally along the lines IV—IV of FIG. 3.
Figure 6:
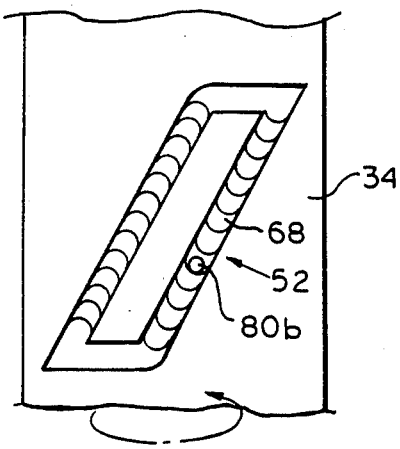
FIG. 6 is a schematic view of the capturing of the pin in a counter clockwise direction of rotation of the agitator barrel.

Although different configurations of length and angle of the channels can be utilized to achieve different vertical speeds and reciprocation periods, in the preferred embodiment of the invention, the stroke of the agitator is too short for the pin 80 to move entirely up the incline in one oscillation motion of the agitator. Thus, as the direction of the agitator barrel changes, as shown in FIG. 6 to a counterclockwise direction, the pin **80*b* is captured and prevented from moving downwardly in the channel 68 by engagement with the ratchet teeth 76 as seen in FIG. 4. As the pin moves upwardly in the channel 68 it carries the thruster 38 upwardly, thereby imparting a vertical movement to the thruster. The intermittent upward movement of the pin 80 in channel 68 continues as barrel 34 oscillates until the pin reaches the top horizontal transfer channel 64. As seen in FIG. 7, during the next counterclockwise rotation of the agitator barrel 34, the pin 80 moves from position 80*c* at the top of the channel 68 along transfer channel 64 to the top of channel 70 at position 80*d*. The camming action between the pin 80 and the side 60 of the recess 52 occurs in the counterclockwise direction of movement shown in FIG. 7. Upon a return to the clockwise direction of movement as shown in FIG. 8, the pin is held at position 80*e* by interaction with the oppositely faced ratchet teeth. During subsequent oscillations of the agitator barrel 34, the thruster 38 is caused to move downwardly intermittently until the pin reaches the bottom of channel 70 and is caused to move relative to lower horizontal transfer channel 66** to repeat the cycle described above.

Thus, as the pin 80 moves upwardly in the channel 68 the thruster 38 is likewise carried upwardly. The thruster 38 is restricted from rotating by the clothes as the agitator 34 moves in a clockwise direction, but it is carried with the agitator 34 in a counterclockwise direction. As the pin 80 moves downwardly in channel 70, the opposite action is achieved. That is, the thruster moves downwardly intermittently during counterclockwise rotation of the agitator and is rotatingly carried with the agitator during clockwise motion. Therefore, the thruster induces two actions to the clothes, vertical and rotational, and with the oscillation of the barrel 34 and vanes 36, a third action is added resulting in a triple action agitator.

In FIGS. 9 through 12 there is shown an alternative embodiment of the present invention in which a substantially identical area **52*a* shown in the form of a parallelogram is recessed in the agitator barrel 34*a*. Parallel to the inclined sides of the recessed area is a land area 62*a* having oppositely notched surfaces 88, 90 with respective notches or recesses 94, 96. Fixed on the interior wall 78*a* of the thruster sleeve 38*a* is a pin type projection 92 that moves freely in the recessed area between the sides of the parallelogram 52*a* and the land area 62*a*. When clothes are placed in the wash bath in the basket 24, they restrict the rotational movement of the thruster 38*a***.

The pin projection 92 starting position for illustration is in the bottom right corner of the recessed area **52*a* shown in FIG. 11 as position 92*a*. As the agitator barrel 34*a* is rotated clockwise the pin is cammed against side 58*a* and is urged upwardly to a position shown at 92*b*. As the agitator barrel 34*a* begins to rotate in a counterclockwise direction, the side 88 of the land area 62*a* engages the pin 92 and captures it in one of the notched areas 94 as shown in position 92*c*. Upon a return to clockwise rotation of the agitator barrel 34*a*, the pin is released from the notch 94 and is cammed further up the side 58*a* of the recessed area until it reaches the top of side 58*a*. At that point, as shown in FIG. 12, when the rotation of agitator barrel 34*a* returns again to the counterclockwise direction, the pin moves relative to the top side 54 and is cammed against the left angled side 60*a* of the recessed area. Clockwise movement of the agitator barrel 34*a* will cause the pin 92 to be captured in recesses 96 on side 90 of the land area 62*a* and counterclockwise movement will cause the pin and thus the thruster 38*a* to move downwardly. This cycle of movement is repeated as long as the agitator 34*a*** moves in an oscillatory motion, thus imparting intermittent rotational and vertical reciprocating motion to the thruster.

Thus, a triple motion agitator is provided for imparting energy into the clothes in an automatic washing machine which includes a reciprocating lower portion and an upper thruster portion imparting both rotational and vertical motion into the clothes.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an automatic washer having a basket for receiving clothes to be washed, an agitator means within said basket for agitating the clothes during a wash cycle, said agitator means including an upper portion, and motor means drivingly connected to said agitator, a secondary agitation means mounted on said agitator for enhancing rollover of said clothes in said basket during agitation, said secondary agitation means comprising:

a driven thruster barrel surrounding said upper portion of said agitator, said driven barrel having vane means on an exterior portion for forcing clothes downwardly along said upper portion of said agitator, said driven barrel further provided with an inwardly projecting pin means, said upper portion of said agitator barrel containing a recessed area for receiving said pin means, said recessed area comprising a first non-horizontal cam channel with stop means therein allowing upward movement of said pin means but restricting downward movement, a second non-horizontal cam channel with stop means therein allowing downward movement of said pin means but restricting upward movement, and upper and lower generally horizontal transfer channels connecting said first and second channels, whereby rotation of said agitator causes said first and second channels to alternately engage said pin means, camming it in a direction allowed by said channel thereby reciprocating said driven barrel vertically about said upper portion of said agitator when said agitator is driven in agitation by said motor means.

2. The device of claim 1, wherein said channels form the legs of a parallelogram.

3. The device of claim 1, wherein said non-horizontal channels are comprised of an inner wall, an outer wall and a bottom wall, said outer wall acting as a camming surface.

4. The device of claim 3, wherein said means restricting movement of said pin means through said channels is incorporated in said bottom wall.

5. The device of claim 4, wherein said means restricting movement comprise rachet teeth formed in said bottom wall and said pin means includes a biasing means urging said pin means against said teeth.

6. The device of claim 3, wherein said means restricting movement of said pin means through said channels is incorporated in said inner wall.

7. The device of claim 6, wherein said means restricting movement comprises notches in said inner wall capable of restricting movement of said pin means along said inner wall.

8. In an automatic washer having a basket for receiving clothes to be washed, an agitator means within said basket for effecting primary agitation of the clothes during a wash cycle, a motor means connected by a drive shaft to said agitator, a secondary agitation means rotatably mounted on an upper portion of said agitator for enhancing rollover of said clothes in said basket during agitation, said secondary agitation means comprising:

an agitator thruster having an inwardly projecting pin means, a recessed area in an outer surface of said agitator means for receiving said pin means, said recessed area comprising a continuous channel having an upper horizontal leg, a lower horizontal leg and two angled legs connecting the ends of said horizontal legs and including means allowing one way movement of said pin means around said channel whereby rotation of said agitator causes said angled channel legs to alternately engage said pin means, moving it in a direction allowed by said channel thereby reciprocating said agitator thruster vertically as said drive shaft oscillates.

9. The device of claim 8, wherein said continuous channel is in the shape of a parallelogram.

10. The device of claim 8, wherein said agitator thruster has a plurality of vanes on an exterior surface for forcing clothes downwardly along said upper portion of said agitator.

11. A means for converting oscillatory rotation into vertical reciprocating motion comprising:

a rotationally oscillating drive barrel, a thruster barrel rotatably and reciprocably mounted on said drive barrel, means retarding rotary movement of said thruster barrel, pin means projecting radially from one of said barrels toward the other, recessed channel means formed in the surface of the other of said barrels to receive said pin means, said channel means comprising a circuit with upper and lower legs and angled side legs connecting said upper and lower legs and including means allowing one way movement of said pin means around said channel circuit, whereby rotational movement of said drive barrel will cause relative movement between said pin means and said channel means causing said pin means to move around said channel circuit in the direction allowed by said channel means thereby causing said thruster barrel to reciprocate.

12. The device of claim 11, wherein said pin means projects from said thruster barrel.

13. The device of claim 11, wherein said channel legs form a parallelogram.

14. The device of claim 11, wherein said pin means is biased toward said channel and said angled channel legs are comprised of an inner wall, an outer wall and a bottom wall, said outer wall acting as a camming surface and said bottom wall having rachet teeth formed therein engagable with said biased pin means to provide said one way movement of said pin means around said channel circuit.

15. The device of claim 11, wherein said angled channel legs are comprised of an inner wall, an outer wall and a bottom wall, said outer wall acting as a camming surface and said inner wall having notches engagable with said pin means to prevent movement of said pin means along said inner wall to provide said one way movement of said pin means around said channel circuit.

* * * * *